US007379696B2

(12) United States Patent
Sawada et al.

(10) Patent No.: US 7,379,696 B2
(45) Date of Patent: May 27, 2008

(54) TONER FOR DEVELOPING ELECTROSTATIC IMAGE, FIXING METHOD FOR FIXING IMAGE FORMED OF THE TONER, AND IMAGE FORMING METHOD AND PROCESS CARTRIDGE USING THE TONER

(75) Inventors: Toyoshi Sawada, Odawara (JP); Keiko Matsumoto, Susono (JP)

(73) Assignee: Ricoh Company Limited, Tokyo (JP)

( * ) Notice: Subject to any disclaimer, the term of this patent is extended or adjusted under 35 U.S.C. 154(b) by 251 days.

(21) Appl. No.: 11/108,646

(22) Filed: Apr. 19, 2005

(65) Prior Publication Data

US 2005/0250037 A1 Nov. 10, 2005

(30) Foreign Application Priority Data

Apr. 30, 2004 (JP) ..... 2004-136070

(51) Int. Cl.
*G03G 9/08* (2006.01)
*G03G 15/01* (2006.01)

(52) U.S. Cl. ..... 399/328; 399/339; 399/252; 399/262; 430/109.4; 430/124.1; 430/124.3

(58) Field of Classification Search ..... 430/109.4, 430/124.1, 124.3; 399/252, 262, 328, 339
See application file for complete search history.

(56) References Cited

U.S. PATENT DOCUMENTS 5,541,031 A 7/1996 Yamashita et al.
5,576,393 A 11/1996 Yamashita et al.
6,074,795 A 6/2000 Watanabe et al.
6,103,441 A 8/2000 Tomita et al.
6,168,894 B1 1/2001 Aoki et al.

(Continued)

FOREIGN PATENT DOCUMENTS

EP 1 126 324 A1 8/2001

(Continued)

OTHER PUBLICATIONS

U.S. Appl. No. 11/687,404, filed Mar. 16, 2007, Seshita et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

A toner including toner particles including a colorant; a binder resin; and a release agent, wherein the binder resin includes a polyester resin (A) having a crystallinity and a specific formula (1), wherein a molar ratio of the ester bond of the crystalline polyester resin to total ester bonds included in the binder resin is not less than 0.60, and wherein the toner has a weight average particle diameter of from 3.0 to 9.0 μm, and includes toner particles having a particle diameter not greater than 5 μm in an amount of from 60 to 90% by quantity. A fixing method in which a toner image of the toner is fixed with a fixing device including a fixing roller having a thickness not greater than 1.0 mm and a pressure roller, wherein the fixing pressure is not greater than $1.5\times10^5$ Pa. An image forming method and a process cartridge using the toner are also provided.

9 Claims, 4 Drawing Sheets

U.S. PATENT DOCUMENTS

| | | | | |
|---|---|---|---|---|
| 6,180,298 | B1 | 1/2001 | Kuroda et al. | |
| 6,363,229 | B1 | 3/2002 | Shiraishi et al. | |
| 6,566,026 | B2 | 5/2003 | Watanabe et al. | |
| 6,653,037 | B2 | 11/2003 | Sawada et al. | |
| 6,716,561 | B2 | 4/2004 | Shiraishi et al. | |
| 6,740,461 | B2 | 5/2004 | Yamashita et al. | |
| 6,821,698 | B2 | 11/2004 | Sawada et al. | |
| 6,830,859 | B2 | 12/2004 | Shiraishi et al. | |
| 6,852,459 | B2 | 2/2005 | Katoh et al. | |
| 6,858,365 | B2 | 2/2005 | Sawada et al. | |
| 2001/0018157 | A1* | 8/2001 | Aoki et al. | 430/109.4 |
| 2003/0036010 | A1 | 2/2003 | Suzuki et al. | |
| 2003/0162018 | A1 | 8/2003 | Saito et al. | |
| 2003/0165759 | A1 | 9/2003 | Suzuki et al. | |
| 2003/0219670 | A1* | 11/2003 | Sawada et al. | 430/109.4 |
| 2004/0121254 | A1 | 6/2004 | Nagayama et al. | |
| 2004/0157147 | A1 | 8/2004 | Shiraishi et al. | |
| 2004/0234879 | A1 | 11/2004 | Hasegawa et al. | |
| 2005/0008961 | A1 | 1/2005 | Takada et al. | |
| 2005/0008962 | A1 | 1/2005 | Katoh et al. | |

FOREIGN PATENT DOCUMENTS

| | | |
|---|---|---|
| EP | 1 365 291 A1 | 11/2003 |
| JP | 62-63940 | 3/1987 |
| JP | 9-222750 | 8/1997 |
| JP | 11-249339 | 9/1999 |
| JP | 2001-222138 | 8/2001 |
| JP | 2002-82474 | 3/2002 |
| JP | 2003-167384 | 6/2003 |

OTHER PUBLICATIONS

U.S. Appl. No. 11/687,875, filed Mar. 19, 2007, Kojima et al.
U.S. Appl. No. 11/855,806, filed Sep. 14, 2007, Awamura et al.
U.S. Appl. No. 11/856,379, filed Sep. 17, 2007, Sawada et al.
European Office Action from corresponding application No. 05 009 125.5 dated Mar. 20, 2006.

* cited by examiner

TONER FOR DEVELOPING ELECTROSTATIC IMAGE, FIXING METHOD FOR FIXING IMAGE FORMED OF THE TONER, AND IMAGE FORMING METHOD AND PROCESS CARTRIDGE USING THE TONER

BACKGROUND OF THE INVENTION

1. Field of the Invention

The present invention relates to a toner for use in developing electrostatic images formed by a method such as electrophotography. In addition, the present invention also relates to a fixing method for fixing toner images, and an image forming method and a process cartridge in which visual images are produced using a toner.

2. Discussion of the Background

Electrophotographic image forming methods typically include the following processes:

(1) an electrostatic latent image is formed on an image bearing member such as photoreceptors (electrostatic latent image forming process);

(2) the electrostatic latent image is developed with a developer including a charged toner to form a visual toner image on the image bearing member (developing process);

(3) the toner image is transferred onto a receiving material optionally via an intermediate transfer medium (transfer process); and (4) the toner image on the receiving material is fixed upon application of heat and/or pressure thereto, resulting in production of a hard copy (fixing process).

Among the methods for use in the fixing process, heat fixing methods are widely used. Recently, in order to save energy, toner images are fixed at a low temperature and therefore the heat energy applied to the toner images becomes smaller and smaller. In addition, it is needed to decrease the warm-up time of image forming apparatus, while the electric power consumption of the apparatus is decreased in a waiting state to protect environment. Requirements for next generation image forming apparatuses are described in the DSM (Demand-side Management) program of IEA (International Energy Agency). There are several requirements therein such that the warm-up time should not be greater than 10 seconds and the power consumption in a waiting state should be not greater than 10 to 30 watt (which changes depending on the copying speed) in copiers having a copy speed not less than 30 cpm (copies per minutes). In order to fulfill these requirements, the power consumption of copiers must be dramatically reduced. In attempting to fulfill the requirements, the following methods have been studied:

(1) to provide a fixing device using a fixing element which has a relatively low thermal capacity and which has a quick temperature rising property while reducing the power consumption in a waiting state; and (2) to develop a toner having a good low temperature fixability so as to be used for low temperature fixing devices.

Heat fixing methods are broadly classified into contact heat fixing methods and non-contact heat fixing methods. Specific examples of the contact heat fixing methods include heat roller fixing methods, belt fixing methods, etc. Specific examples of the non-contact heat fixing methods include flash fixing methods, oven fixing methods, etc. Among these heat fixing methods, the heat roller fixing methods are widely used because of having the following advantages:

(1) the heat roller fixing methods have good heat efficiency because a heat roller therein is contacted with toner images to be fixed; and (2) the fixing devices for use in the heat roller fixing methods are small in size.

In attempting to quickly raise the temperature of a heat roller, which results in reduction of the waiting time, published unexamined Japanese patent applications Nos. (hereinafter referred to as JP-As) 09-222750 and 2002-82474 have disclosed methods in which a roller having a thickness not greater than 1.0 mm is used as a fixing roller which heats toner images while contacting the toner images. By using such a thin fixing roller, the fixing temperature can be raised to a predetermined temperature in a very short period of time. However, such a heat roller has a low mechanical strength, and therefore a high load cannot be applied to the heat roller to avoid deformation of the heat roller. Since a high load cannot be applied to the heat roller (i.e., since it is impossible for the fixing method using such a thin fixing roller to decrease the lowest fixable temperature while applying a high load to toner images), it is necessary to develop a toner having a relatively low temperature fixability for the fixing method.

In attempting to prepare a toner having a low temperature fixability, a method in which polyester resins, which have relatively good low temperature fixability and good high temperature preservability, are used as binder resins instead of styrene-acrylic resins which have been typically used as binder resins. In order to further decrease the lowest fixable temperature of a toner, it is necessary to control the thermal properties of the binder resin itself of the toner. However, when a resin having a low glass transition temperature (Tg) is used as a binder resin, the high temperature preservability of the resultant toner deteriorates. When a resin having a low softening point [T(F1/2)] is used as a binder resin, the hot offset generating temperature of the resultant toner decreases. Therefore, a toner having a good low temperature fixability and a high hot offset temperature cannot be produced at the present time even when one or more polyester resins are used for the toner while the thermal properties of the resins are controlled.

In attempting to solve the problem, JP-A62-63940discloses a method in which a specific non-olefin type crystalline polymer having a sharp melting property at its glass transition temperature is included in a toner. JP-A2003-167384 discloses a crystalline polyester resin an example of the specific non-olefin type crystalline polymer. However, even when these resins are used, the low temperature fixability of the resultant toners is not fully satisfactory.

Therefore, in order to fulfill the requirements in the DSM Program, a further improved low temperature fixing technique has to be established.

SUMMARY OF THE INVENTION

Accordingly, an object of the present invention is to provide a toner which has not only a good combination of high temperature preservability, durability and hot offset resistance, but also a good low temperature fixability so as to be used for a heat roller fixing method in which toner images are fixed using a thin fixing roller while applying a low pressure thereto and which can produce high quality and high definition images having little background fouling.

Another object of the present invention is to provide a fixing method by which toner images can be fixed at a relatively low temperature using a thin fixing roller.

Yet another object of the present invention is to provide an image forming method and a-process cartridge by which high quality and high definition images having little background fouling can be stably produced for a long period of time.

Briefly these objects and other objects of the present invention as hereinafter will become more readily apparent can be attained by a toner including:

a colorant;

a binder resin including:

a polyester resin (A) having a crystallinity and an ester bonding represented by the following formula (1):

$$—OOC—R—COO—(CH_2)_n— \quad (1)$$

wherein R represents a linear unsaturated aliphatic group having from 2 to 20 carbon atoms, and n is an integer of from 2 to 20; and a release agent, wherein the molar ratio of the ester bond of the crystalline polyester resin to total ester bonds included in the binder resin is not less than 0.60, and wherein the toner has a weight average particle diameter of from 3.0 to 9.0 μm, and includes toner particles having a particle diameter not greater than 5 μm in an amount of from 60 to 90% by quantity (i.e., by number) when the weight average particle diameter and particle diameter are measured using MULTISIZER manufactured by Beckmann Coulter, Inc.

The toner preferably has a thermal property such that when the toner is subjected to differential scanning calorimetry, the toner has at least three endothermic peaks, wherein the peak tops of the first, second and third peaks are present in temperature ranges of from 40 to 70° C., from 70 to 90° C. and from 80 to 130° C., respectively.

The toner preferably has an X-ray diffraction spectrum such that a diffraction peak is observed at a Bragg (2θ) angle of from 20° to 25°.

The crystalline polyester resin preferably has a softening point of from 80 to 130° C. and a glass transition temperature of from 80 to 130° C.

It is preferable that the crystalline polyester resin is included in the toner in an amount of from 1 to 50% by weight based on the total weight of the toner.

The crystalline polyester resin preferably includes an alcohol unit obtained from 1,4-butanediol or 1,6-hexanediol and an acid unit obtained from maleic acid or fumaric acid.

It is preferable that the binder resin further includes a noncrystalline polyester resin having a glass transition temperature of from 40 to 70° C. and a softening point of from 120 to 160° C.

The release agent preferably has a glass transition temperature of from 70 to 90° C.

The crystalline polyester resin preferably has an X-ray diffraction spectrum such that a diffraction peak is observed in each of Bragg (2θ) angle ranges of from 19° to 20°, 21° to 22°, 23° to 25° and 29° to 31°.

As another aspect of the present invention, a fixing method for fixing a toner image formed of the toner mentioned above is provided, which includes:

providing a first roller having a heater therein and a second roller, wherein the first roller is a cylinder having a thickness not greater than 1.0 mm and the first and second rollers are rotated while contacted with each other at a pressure not greater than $1.5\times10^5$ Pa, and passing a support bearing the toner image through a nip between the first and second rollers such that the toner image contacts the first roller.

As yet another aspect of the present invention, an image forming method is provided which includes:

developing an electrostatic latent image on an image bearing member with a developer including the toner of the present invention mentioned above to form a toner image thereon; and transferring the toner image onto a receiving material.

As a further aspect of the present invention, a process cartridge is provided which includes at least a developing device configured to develop an electrostatic latent image on an image bearing member with a developer including the toner of the present invention and a housing. The process cartridge optionally includes a charger configured to charge the image bearing member and a cleaner configured to clean the surface of the image bearing member. The process cartridge is detachably attached to an image forming apparatus.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
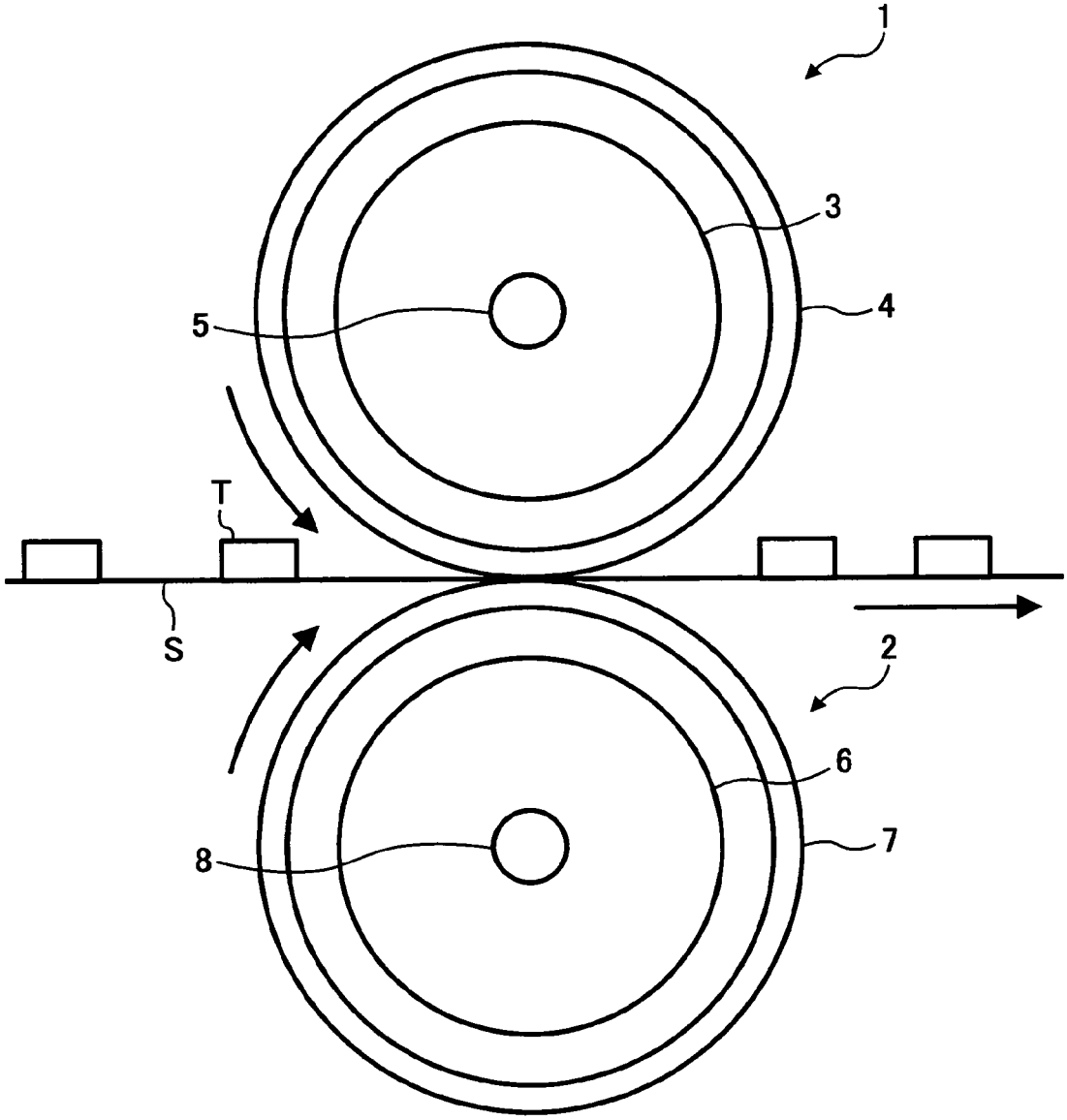
FIG. 1 is a schematic view illustrating the cross section of a fixing device for use in the fixing method of the present invention.

The toner of the present invention has a weight average particle diameter of from 3 to 9 μm. When the weight average particle diameter falls in this range, the resultant toner images have good dot reproducibility because the particle diameter of the toner is much smaller than the size (i.e., width or diameter) of a latent dot image constituting electrostatic latent images to be developed with the toner. In addition, the toner particles can be melted at a low energy and therefore the toner has good low temperature fixability.

When the weight average particle diameter is too small, the productivity of the toner deteriorates and in addition a problem in that toner particles remaining on an image bearing member cannot be sufficiently removed therefrom occurs.

In contrast, when the weight average particle diameter is too large, the energy needed for melting a toner particle is large, and therefore the toner has poor low temperature fixability and causes a toner scattering problem in that character images and line images are scattered.

The toner includes toner particles having a particle diameter not greater than 5 μm in an amount of from 60 to 90% by quantity (i.e., by number). When the amount is too small, the resultant toner images have poor dot reproducibility because the content of small toner particles which can faithfully develop fine electrostatic latent images is low. In addition, the energy needed for melting a toner particle increases, and therefore the toner has poor low temperature fixability. In contrast, when the amount is too large, the toner has poor fluidity and therefore it becomes difficult to uniformly charge the toner, resulting in occurrence of a toner scattering problem in that toner particles scatter in the developing device, etc., resulting in contamination of image forming members and a background fouling problem in that the background of a toner image is soiled with toner particles.

In the present application, the weight average particle diameter and particle diameter distribution of a toner are determined by an instrument such as COULTER COUNTER TA-II and MULTISIZER II, both of which are manufactured by Beckman Coulter, Inc. The measurement method is as follows:

(1) a surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;
(2) 2 to 20 mg of a sample (i.e., a toner) to be measured is added into the mixture;
(3) the mixture is subjected to an ultrasonic dispersion treatment for about 1 to 3 minutes; and
(4) the volume average particle diameter distribution and number average particle diameter distribution of the toner are measured using the instrument mentioned above and an aperture of 100 μm.

The weight average particle diameter of the toner can be determined from the thus obtained volume and number average particle diameter distributions.

In this case, the particle diameter channels are following 13 channels:

2.00 μm≦C1<2.52 μm; 2.52 μm≦C2<3.17 μm;
3.17 μm≦C3<4.00 μm; 4.00 μm≦C4<5.04 μm;
5.04 μm≦C5<6.35 μm; 6.35 μm≦C6<8.00 μm;
8.00 μm≦C7<10.08 μm; 10.08 μm≦C8<12.70 μm;
12.70 μm≦C9<16.00 μm; 16.00 μm≦C10<20.20 μm;
20.20 μm≦C11<25.40 μm; 25.40 μm≦C12<32.00 μm; and
32.00 μm≦C13<40.30 μm.

Thus, particles having a particle diameter not less than 2.00 μm and less than 40.30 μm are targeted.

Then the fixing method of the present invention will be explained referring to FIG. 1.

FIG. 1 illustrates a fixing device for use in the fixing method of the present invention. In FIG. 1, numerals 1 and 2 denote a fixing roller and a pressure roller, respectively. The fixing roller 1 includes a cylinder 3 which is typically made of a metal having a high heat conductivity such as aluminum, iron, stainless steel and brass; and an offset preventing layer 4 which is located overlying the cylinder and which is typically made of a material such as RTV (room temperature vulcanization) silicone rubbers, tetrafluoroethylene-fluoroalkylvinyl ether copolymers (hereinafter referred to as PFAs), and polytetrafluoroethylene (hereinafter referred to as PTFEs). A heating lamp 5 is provided inside the fixing roller 1.

The pressure roller 2 includes a cylinder 6 which is made of one or more of the metals mentioned above for use in the cylinder 3, and an offset preventing layer 7 which is located overlying the cylinder 6 and which is formed of a material such as PFAs and PTFEs. The pressure roller 2 optionally includes a heating lamp 8 therein.

The fixing roller 1 and pressure roller 2 are rotated while pressed to each other by springs (not shown) which are provided on both sides of the rollers 1 and 2. A support S (such as papers) bearing a toner image T thereon is fed into the nip between the fixing roller 1 and pressure roller 2.

Since the fixing roller 2 has the metal cylinder 3 having a thickness not greater than 1.0 mm, the fixing roller has good temperature rising property, i.e., the temperature of the fixing roller 1 can be raised to a predetermined temperature in a very short period of time. The thickness of the metal cylinder 3 is preferably from 0.2 to 0.7 mm although the thickness is determined depending on the mechanical strength and heat conductivity of the metal used. When the thickness of the metal cylinder is not greater than 1.0 mm, the heat generated by the heater inside the metal cylinder can be rapidly and efficiently transferred to the surface of the metal cylinder. Therefore, the difference in temperature between the heater and the surface of the metal cylinder can be miniaturized, and thereby the temperature of the heater can be decreased, resulting in reduction of power consumption.

The pressure applied to the fixing roller 1 and the pressure roller 2 is preferably not greater than $1.5\times10^5$Pa. The higher the pressure, the better fixing property the toner images have. However, when the pressure is too high, the thin metal cylinder tends to be deformed. Therefore, the pressure is preferably not greater than $1.5\times10^5$ Pa, and more preferably from 0.5 to $1.0\times10^5$ Pa. When the pressure is too high, the hot offset problem in that a part or the entire of toner images on a receiving sheet is transferred to the fixing roller, and the toner image on the fixing roller is re-transferred to another portion of the receiving sheet or a portion of another sheet tends to occur. In contrast, when the pressure is too low, the adhesive strength of toner images to a receiving material decreases.

In this regard, the pressure (P) is defined as the following equation:

$$P=L/CA,$$

wherein L represents load applied to both ends of the rollers, and CA represents the area of the contact point of the rollers.

The contact area (CA) can be determined as follows.

(1) a sheet which can change its surface property upon application of heat thereto, such as OHP (overhead projection) sheets, is fed into the nip between the fixing roller and the pressure roller, which are heated to the fixing temperature;
(2) feeding of the sheet is suddenly stopped so that the sheet is sandwiched by the rollers;
(3) tens seconds after stopping the sheet, the sheet is fed again to be discharged; and
(4) the area of the sandwiched portion of the sheet, whose surface condition is changed, is measured to determine the contact area.

Then crystalline polyester resins for use in the toner of the present invention will be explained.

Crystalline polyester resins induce crystal transition at the glass transition temperature (Tg) thereof, and at the same time the resins rapidly melt (i.e., rapidly change the phase from a solid state to a liquid state). Thus, the polyester resins exhibit a fixability to receiving materials at the temperature.

In contrast, noncrystalline resins have a thermal property such that the melt viscosity thereof gradually decreases from the glass transition temperature thereof, and thereby it takes a long time until the resins exhibit a fixability. Therefore, it is necessary to reduce the melt viscosity at a low temperature by using a resin having a low glass transition temperature or a resin having a low molecular weight. However, in these cases the preservability and hot offset resistance of the resultant toner deteriorate. By using a crystalline polyester resin for a toner, the melt viscosity can be decreased without deteriorating the preservability and hot offset resistance of the toner.

Since crystalline polyester resins have a thermal property such that they melt at the glass transition temperature thereof and the melt viscosity thereof rapidly decreases, a crystalline polyester resin having a relatively high glass transition temperature can be used for toner compared to a toner for which a noncrystalline polyester resin, is used. Therefore, the toner has good thermal stability. Namely, the toner of the present invention in which a crystalline polyester resin is present on a surface portion of toner particles has good high temperature preservability. Therefore, a noncrystalline polyester resin having a low glass transition temperature can be included in the toner, and thereby the low temperature fixability of the toner can be further improved.

The added amount of the crystalline polyester resin included in the toner of the present invention is not less than 1 part by weight, and preferably not less than 5 parts by weight, per 100 parts by weight of the binder resin, to impart good low temperature fixability to the resultant toner. When the added amount is too large, the resultant toner has poor hot offset resistance. Therefore, the added amount is preferably not greater than 50 parts by weight, and more preferably not greater than 30 parts by weight.

The lowest fixable temperature of the toner of the present invention can be adjusted by adjusting the glass transition temperature and softening point of the crystalline polyester resin used instead of the above-mentioned adjustment of the added amount. It is preferable to decrease the lowest fixable temperature of the toner without deteriorating the high temperature preservability thereof. Therefore, it is preferable to use a crystalline polyester resin having a glass transition temperature of from 80 to 130° C. and a softening point of from 80 to 130° C. as a binder resin. Crystalline polyester resins having too low a glass transition temperature and a softening point have too low a melt viscosity at the fixing temperature. Therefore such resins are not suitable as the binder resin of the toner of the present invention because the resultant toner has poor fixing ability at the fixing temperature. In contrast, when a crystalline polyester resins having too high a glass transition temperature and a softening point is used for a toner, the lowest fixable temperature of the toner increases, i.e., the toner has poor low temperature fixability.

In order to improve the hot offset resistance without deteriorating the low temperature fixability, a noncrystalline resin is preferably included in the toner. In this case, noncrystalline resins having a glass transition temperature of from 40 to 70° C. and a softening point of from 120 to 160° C. are preferably used. When a noncrystalline resin having too low a glass transition temperature is used, the toner has poor high temperature preservability, thereby causing a blocking problem in that toner particles aggregate even when preserved or used at a relatively low temperature. In contrast, when a resin having too high a glass transition temperature is used, the resultant toner has poor low temperature fixability.

When a noncrystalline resin having too low a softening point is used, the resultant toner has poor hot offset resistance. In contrast, when a resin having too high a softening point is used, a problem which occur is that a high shearing force has to be applied to the toner composition mixture including the resins, a crystalline polyester resin, a colorant, a release agent, etc., when kneading the toner composition mixture while heating to mix the toner composition mixture, or the toner composition mixture cannot be well mixed. In this case, the low temperature fixability of the toner deteriorates.

The toner of the present invention includes a release agent. The release agent preferably has a glass transition temperature of from 70 to 90° C. When a release agent having too low a glass transition temperature is used, the resultant toner has poor high temperature preservability. In contrast, when a release agent having too high a glass transition temperature is used, the resultant toner has poor releasability at a low fixing temperature, thereby causing a cold offset problem and a problem in that receiving materials adhere to a fixing device (such as a fixing roller).

The toner of the present invention preferably includes not only a crystalline polyester resin but also a noncrystalline polyester resin which is incompatible with the crystalline polyester resin such that the resins create a phase separation state. In this case, the resultant toner has a good combination of hot offset resistance and low temperature fixability because the respective characteristics of the resins can be exhibited without being deteriorated by the other resin. Namely, the noncrystalline polyester resin which has a higher softening point can impart good hot offset resistance to the toner, and the crystalline polyester resin which has a lower softening point imparts good low temperature fixability to the toner.

Whether a crystalline polyester resin and a noncrystalline polyester resin in a toner are in a phase separation state can be determined by any one of the following methods:

1. A method in which the cross section of the toner with a transmission electron microscope (TEM). Specifically, when the resins are in a phase separation state, a colorant (such as carbon black) included in the toner is selectively dispersed in the noncrystalline polyester resin while hardly dispersed in the crystalline polyester resin. Therefore, if a portion including no pigment is present like islands in the cross section of a toner, it can be said that the resins in the toner have a phase-separation structure.
2. A method in which the toner is subjected to differential scanning calorimetry to determine whether endothermic peaks are observed. In this regard, if the toner includes a crystalline polyester resin, a noncrystalline polyester resin and a release agent and there are three endothermic peaks (A), (B) and (C) which are intrinsic to the crystalline polyester resin, the release agent and the noncrystalline polyester resin, respectively, it can be said that the resins have a phase-separation structure. It is preferable for the toner that the top of the peak (A) is present in a temperature range of from 40 to 70° C., the toner of the peak (B) is present in a temperature range of from 70 to 90° C., and the toner of the peak (C) is present in a temperature range of from 80 to 130° C.

When the toner has a phase separation structure, separate three endothermic peaks can be observed. In contrast, when the toner does not have a phase separation structure, only one peak in which the three peaks overlap can be observed.

3. A method in which the toner is subjected to an X-ray diffraction analysis. If the crystalline polyester resin and the noncrystalline polyester resin achieve a phase separation state, a peak intrinsic to the crystalline polyester resin can be observed in a Bragg (2θ) angle range of from 20 to 25° C. If the crystalline polyester resin and the noncrystalline polyester resin do not have a phase separation structure, the peak intrinsic to the crystalline polyester resin cannot be observed because the crystalline polyester resin is mixed with the noncrystalline polyester resin.

In the present application, the glass transition temperature and melting point of a resin and a toner are measured using a differential scanning calorimeter DSC-60 from Shimadzu Corp., under the following conditions:

Temperature range: 20 to 150° C.

Temperature rising speed: 10° C./min

Soon after being subjected to a first heating treatment, the sample is subjected to a cooling treatment at a cooling speed of 10° C./min. The sample is subjected to a second heating treatment. The glass transition temperature of the sample is determined from the second DSC curve by a tangent line method.

The softening point of a resin and a toner is measured using a flow tester CF-500 from Shimadzu Corp. The measuring conditions are as follows:

Diameter of die: 1 mm

Pressure applied: $9.8\times10^5$ Pa (10 kgf/cm$^2$)

Temperature rising speed: 3° C./min

A sample is heated under the conditions mentioned above. The softening point of the sample is defined as the temperature [T(F1/2)] at which the tip of the rod reaches a mid point between the flow starting point and the flow ending point.

Then crystalline polyester resins for use in the toner of the present invention will be explained.

The toner of the present invention includes a crystalline polyester resin having a structure represented by the following formula (1):

$$—OOC—R—COO—(CH_2)_n— \quad (1)$$

(wherein R represents a linear unsaturated aliphatic group having from 2 to 20 carbon atoms, and n is an integer of from 2 to 20), in an amount of 60% by mole based on the total ester bonds included in the binder resin. In formula (1), R is preferably a linear divalent unsaturated carboxylic acid residual group having from 2 to 20 carbon atoms, and is more preferably a linear unsaturated aliphatic group having from 2 to 4 carbon atoms. Character n is preferably an integer of from 2 to 6.

Specific examples of the linear unsaturated aliphatic group mentioned above include linear unsaturated aliphatic groups which are derived from linear unsaturated dibasic carboxylic acids such as maleic acid, fumaric acid, 1,3-n-propenedicarboxylic acid, 1,4-n-butenedicarboxylic acid, etc.

The group $—(CH_2)_n—$ is a residual group of a linear dihydric aliphatic alcohol. Specific examples of the linear dihydric aliphatic alcohols include ethylene glycol, 1,3-propylene glycol, 1,4-butanediol, 1,6-hexanediol, etc. Since a linear unsaturated aliphatic dicarboxylic acid is used as the carboxylic acid component, polyester resins having a crystalline structure can be easily prepared compared to a case where an aromatic dicarboxylic acid is used as the carboxylic acid component.

The crystalline polyester resins for use in the toner of the present invention can be produced by subjecting the following components (1) and (2) to a polycondensation reaction.

(1) polycarboxylic acids such as linear unsaturated aliphatic dicarboxylic acids or their reactive derivatives (such as anhydrides, alkyl (C1 to C4) esters and acid halides thereof); and (2) polyhydric alcohols such as linear aliphatic diols.

In this regard, a small amount of the following polycarbqxylic acids can be used in combination with the polycarboxylic acids (1).

(1)-1) branched unsaturated aliphatic dicarboxylic acids;

(1)-2) saturated aliphatic polycarboxylic acids such as saturated aliphatic dicarboxylic acids and saturated aliphatic tricarboxylic acids; and (1)-3) aromatic polycarboxylic acids such as aromatic dicarboxylic acids and aromatic tricarboxylic acids.

These polycarboxylic acids (1)-1) to (1)-3) can be used in an amount such that the resultant polyester resin does not lose the crystallinity. Specifically, the added amount is generally not greater than 30% by mole, and preferably not greater than 10% by mole, based on the total amount of the carboxylic acids used for the toner.

Specific examples of such polycarboxylic acids (1)-1) to (1)-3) include dicarboxylic acids such as malonic acid, succinic acid, glutaric acid, adipic acid, suberic acid, sebacic acid, citraconic acid, phthalic acid, isophthalic acid, and terephthalic acid; and tri- or more-carboxylic acids such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In addition, a small amount of polyhydric alcohols such as branched dihydric alcohols, cyclic dihydric alcohols, and tri- or more-hydric alcohols can be used in combination with the above-mentioned polyhydric alcohols (2) such that the resultant polyester resin does not lose the crystallinity.

Specific examples of such polyhydric alcohols include 1,4-bis(hydroxymethyl)cyclohexane, polyethylene glycol, ethylene oxide adducts of bisphenol A, etc. The added amount is generally not greater than 30% by mole, and preferably not greater than 10% by mole, based on the total amount of the alcohols used for the toner.

The crystalline polyester resin included in the toner preferably has a relatively low molecular weight and a sharp molecular weight distribution to impart good low temperature fixability to the toner. Specifically the crystalline polyester resin preferably has a weight average molecular weight (Mw) of from 5,500 to 6,500, a number average molecular weight (Mn) of from 1,300 to 1,500 and a Mw/Mn ratio of from 2 to 5.

The molecular weight distribution of a crystalline polyester resin can be determined from a molecular weight distribution graph in which the molecular weight of components (in the logarithm unit) is plotted on the horizontal axis and the content of the components (i.e., the weight percent) is plotted on the vertical axis. Crystalline polyester resins having a peak in a range of from 3.5 to 4.0, which peak preferably has a half width not greater than 1.5, are preferably used as the binder resin of the toner of the present invention.

The glass transition temperature (Tg) and the softening point [ T(F1/2)] of the crystalline polyester resin included in the toner are preferably as low as possible to an extent such that the high temperature preservability of the resultant toner does not deteriorate. Specifically, the glass transition temperature is generally from 80 to 130° C. and preferably from 80 to 125° C. The softening point is generally from 80 to 130° C. and preferably from 80 to 125° C. When the glass transition temperature and softening point are too high, the lowest fixable temperature of the toner increases, namely the low temperature fixability of the toner deteriorates.

Whether or not a polyester resin has a crystallinity can be determined by subjecting the polyester resin to an X-ray diffraction analysis. If the polyester resin has a crystallinity, specific diffraction peaks are observed in the X-ray diffraction spectrum. Crystalline polyester resins having at least one peak in a Bragg (2θ) angle range of from 20 to 25° are preferably used for the toner of the present invention. More preferably crystalline polyester resins having a peak in each of Bragg (2θ) angle ranges of from 19 to 20°, from 21 to 22°, from 23 to 25° and 29 to 31° are used.

In the present application, the X-ray diffraction analysis is performed under the following measuring conditions.

Measuring instrument: RINT1100 from Rigaku Corp.

Target: Cu

Voltage: 50 kV

Current: 30 mA

Goniometer: wide angle goniometer

Then noncrystalline resins, which are used in combination with a crystalline polyester resin, will be explained.

Any known noncrystalline resins can be used as the noncrystalline resin. Specific examples of the resins include styrene resins (e.g., polystyrene, poly-α-methylstyrene, polychlorostyrene, styrene-propylene copolymers, styrene—butadiene copolymers, styrene-vinyl chloride copolymers, styrene-vinyl acetate copolymers, styrene-maleic acid copolymers, styrene-acrylate copolymers, styrene—methacrylate copolymers, and styrene-acrylonitrile-acrylate copolymers); polyester resins, vinyl chloride resins, rosin-modified maleic acid resins, phenolic resins, epoxy resins, polyethylene resins, polypropylene resins, ionomer resins, polyurethane resins, silicone resins, ketone resins, xylene resins, petroleum resins, hydrogenetated petroleum resins, etc. These noncrystalline resins can be used alone or in combination.

Among these noncrystalline resins, styrene resins and polyester resins are preferably used, and polyester resins are more preferably used.

Noncrystalline polyester resins can be prepared by reacting a polyhydric alcohol with a polycarboxylic acid. Specific examples of the polyhydric alcohols and polycarboxylic acids include the polyhydric alcohols and polycarboxylic acids mentioned above for use in the crystalline polyester resin, and alkylene oxide adducts of bisphenol A, isophthalic acid and terephthalic acids.

It is preferable to use a noncrystalline polyester resin including tetrahydrofuran(THF)-soluble components having a weight average molecular weight (Mw) of from 3,000 to 100,000, a number average molecular weight (Mn) of from 1,500 to 4,000 and a (Mw/Mn) ratio of from 2 to 50, as the noncrystalline resin.

When the molecular weight distribution of a resin is illustrated in a graph in which the molecular weight (in the logarithm unit) is plotted on the horizontal axis and the content (i.e., the weight percent) is plotted on the vertical axis, noncrystalline polyester resins having a peak in a range of from 3.5 to 4.0 are preferably used for the toner of the present invention.

The glass transition temperature (Tg) and the softening point [T(F1/2)] of the noncrystalline polyester resin included in the toner are preferably as low as possible to an extent such that the high temperature preservability of the resultant toner does not deteriorate. Specifically, the glass transition temperature is generally from 40 to 70° C. and preferably from 45 to 65° C. The softening point is generally from 120 to 160° C. and preferably from 130 to 150° C. When the glass transition temperature and softening point are too high, the lowest fixable temperature of the toner increases, namely the low temperature fixability of the toner deteriorates.

The toner of the present invention includes a release agent. Suitable materials for use as the release agent include waxes. Specific examples of the waxes include synthetic waxes such as low molecular weight olefin waxes (e.g., low molecular weight polyethylene and polypropylene) and Fischer-Tropsch waxes; natural waxes such as bees waxes, carnauba waxes, candelilla waxes, rice waxes, and montan waxes; petroleum waxes such as paraffin waxes, and microcrystalline waxes; higher fatty acids such as stearic acid, palmitic acid and myristic acid; metal salts of higher fatty acids, higher fatty acid amides and derivatives of these waxes. These waxes can be used alone or in combination. The release agent is included in the toner in an amount of from 1 to 20 parts by weight, and preferably from 3 to 10 parts by weight, per 100 parts by weight of the resin components included in the toner.

The toner of the present invention includes a colorant. Specific examples of the materials for use as the colorant include known dyes and pigments such as carbon black, iron black, black colored metal compounds with low magnetization (e.g., compounds, oxides and mixture thereof, which include an element selected from the group consisting of Mn, Ti, Cu, Si, C, etc.), Aniline Blue, Phthalocyanine Blue, Phthalocyanine Green, HANSA YELLOW G, Rhodamine 6C Lake, chalco-oil blue, Chrome Yellow, quinacridone, BENZIDINE YELLOW, Rose Bengale, and triarylmethane dyes. These materials can be used alone or in combination. By using these colorants, black toners and full color toners (such as yellow, magenta and cyan toners) can be provided. The added amount of these colorants is generally from 1 to 30% by weight, and preferably from 3 to 20% by weight, based on the total weight of the resin components included in the toner.

When a magnetic material is included in the toner of the present invention, the toner can be used as a magnetic toner. Specific examples of the magnetic materials include iron oxides such as magnetite, hematite, and ferrites; metals such as iron, cobalt, and nickel, and alloys of these metals with a metal such as aluminum, cobalt, copper, lead, magnesium, tin, zinc, antimony, beryllium, bismuth, cadmium, calcium, manganese, selenium, titanium, tungsten, and vanadium. These materials can be used alone or in combination. Among these materials, magnetite is preferably used in view of magnetic properties.

The magnetic materials for use in the toner of the present invention preferably have an average particle diameter of from 0.1 to 2 μm. In addition, the added amount of the magnetic material is generally from 15 to 200 parts by weight, and preferably from 20 to 100 parts by weight, per 100 parts by weight of the resin components included in the toner.

Toner particles of the toner of the present invention can be prepared by any known methods such as kneading/pulverization methods in which toner composition mixture is melted and kneaded, followed by pulverization and classification after cooling, and polymerization methods.

The toner of the present invention optionally includes a charge controlling agent. Specific examples of the charge controlling agents include any known charge controlling agents such as Nigrosine dyes, metal complex salt based dyes, quaternary ammonium salts, etc. These materials can be used alone or in combination. The added amount of the charge controlling agent is from 0.1 to 10 parts by weight, and preferably from 1 to 5 parts by weight, per 100 parts by weight of the resin components included in the toner.

The toner of the present invention optionally includes a fluidity improving agent. Specific examples of the materials for use as the fluidity improving agent include known fluidity improving agents such as hydrophobic silica, titanium oxide, silicon carbide, aluminum oxide, barium titanate, etc. These materials can be used alone or in combination. Among these materials, hydrophobic silica and titanium oxide are preferably used because good fluidity and good charge stability can be imparted to the toner, and thereby the toner can produce high quality images. When a combination of a hydrophobic silica and a titanium oxide isused, the resultant toner has good combination of fluidity and charge stability.

The added amount of the fluidity improving agent is from 0.1 to 5 parts by weight, and preferably from 0.5 to 2 parts by weight, per 100 parts by weight of the toner. A fluidity improving agent is typically included to the toner by being mixed with toner particles using a mixer.

The toner of the present invention is typically prepared by the following method.

(1) toner components such as colorants, binder resins, and release agents are melted and kneaded;
(2) the kneaded toner component mixture is cooled; and
(3) the toner component mixture is pulverized, followed by classification.

However, the method is not limited thereto, and other methods such as suspension polymerization methods, emulsion polymerization methods, dispersion polymerization methods, solution suspension methods, polymer suspension methods, and extension reaction methods can also be used.

The thus prepared toner can be used as a one-component developer and for a two-component developer which is prepared by mixing the toner with a carrier. In any cases, the toner is contained in a container, and the container containing the toner is delivered to customers using the image forming apparatus for which the toner is used so that the customers set the toner container in the image forming apparatus when the toner is exhausted.

The shape of the toner container is not particularly limited, and bottle type containers and cartridge type containers can be used.

The image forming method of the present invention will be explained referring to FIGS. 2 and 3.

Figure 2:
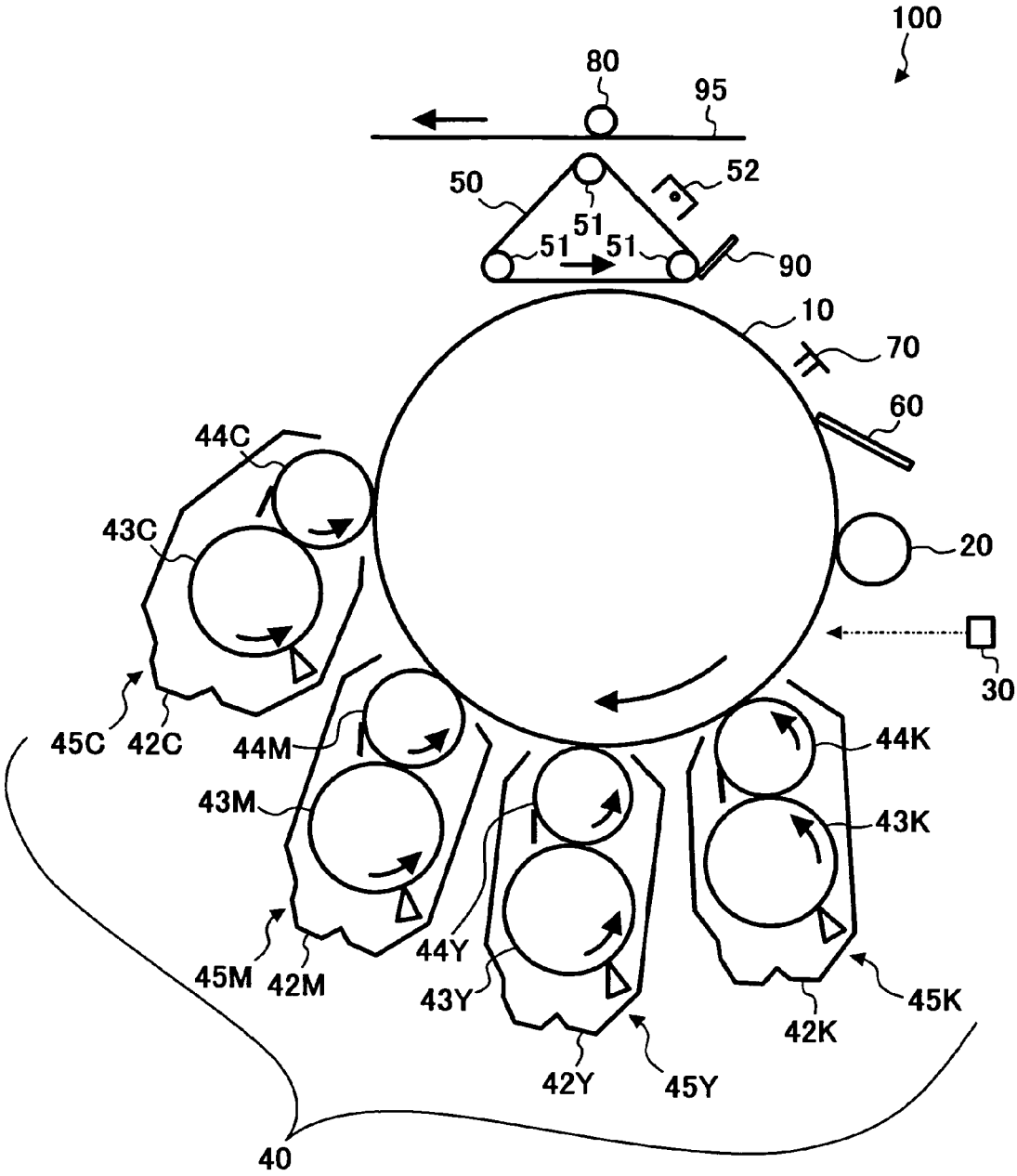
FIG. 2 is a schematic view illustrating the image forming section of an image forming apparatus for use in the image forming method of the present invention.

FIG. 2 is a schematic view illustrating an image forming section of an image forming apparatus for use in the image forming method of the present invention.

In FIG. 2, an image forming apparatus 100 includes a photoreceptor drum 10 (herein after referred to as a photoreceptor 10) serving as the image bearing member; a charging roller 20 serving as the charging device; a light irradiator 30 serving as the latent image forming device; a developing device 40 serving as the image developing device; an intermediate transfer medium 50; a cleaner 60 serving as the cleaning device and including a cleaning blade; and a discharging lamp 70 serving as the discharging device.

The intermediate transfer medium 50 is an endless belt which is rotated in a direction indicated by an arrow by three rollers 51 arranged therein while tightly stretched by the rollers. At least one of the three rollers 51 applies a transfer bias (first transfer bias) to the intermediate transfer medium 50. A cleaner 90 is provided to clean the surface of the intermediate transfer medium 50.

On the upper side of the intermediate transfer medium 50, a transfer roller 80 is provided which applies a transfer bias (a second transfer bias) to a receiving material 95 on which a toner image is to be transferred. In addition, a corona charger 52 is provided to charge the toner image on the intermediate transfer medium 50 before the toner image is transferred to the receiving material 95.

A developing device 40 includes a black developing unit 45K; a yellow developing unit 45Y; a magenta developing unit 45M; and a cyan developing unit 45C. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C).

In the image forming apparatus 100, the surface of the photoreceptor 10 is uniformly charged with the charging roller 20. The light irradiator 30 irradiates the charged surface of the photoreceptor 10 with image wise light to form an electrostatic latent image on the photoreceptor 10. The developing device 40 develops the latent image with color toners, each of which is the toner of the present invention, to sequentially form color toner images on the photoreceptor 10. The color toner images are transferred to the intermediate transfer medium 50 (first transfer) to form a toner image (e.g., a full color toner image) thereon while at least one of the rollers 51 applies a transfer bias thereto. The toner image formed on the intermediate transfer medium 50 is then transferred to the receiving material 95 (second transfer). Particles of the toner remaining on the photoreceptor 10 are removed with the cleaner 60 and charges remaining on the photoreceptor 10 are removed by irradiating the photoreceptor 10 with light using the discharging lamp 70.

The image forming operations will be explained referring to FIG. 3.

Figure 3:
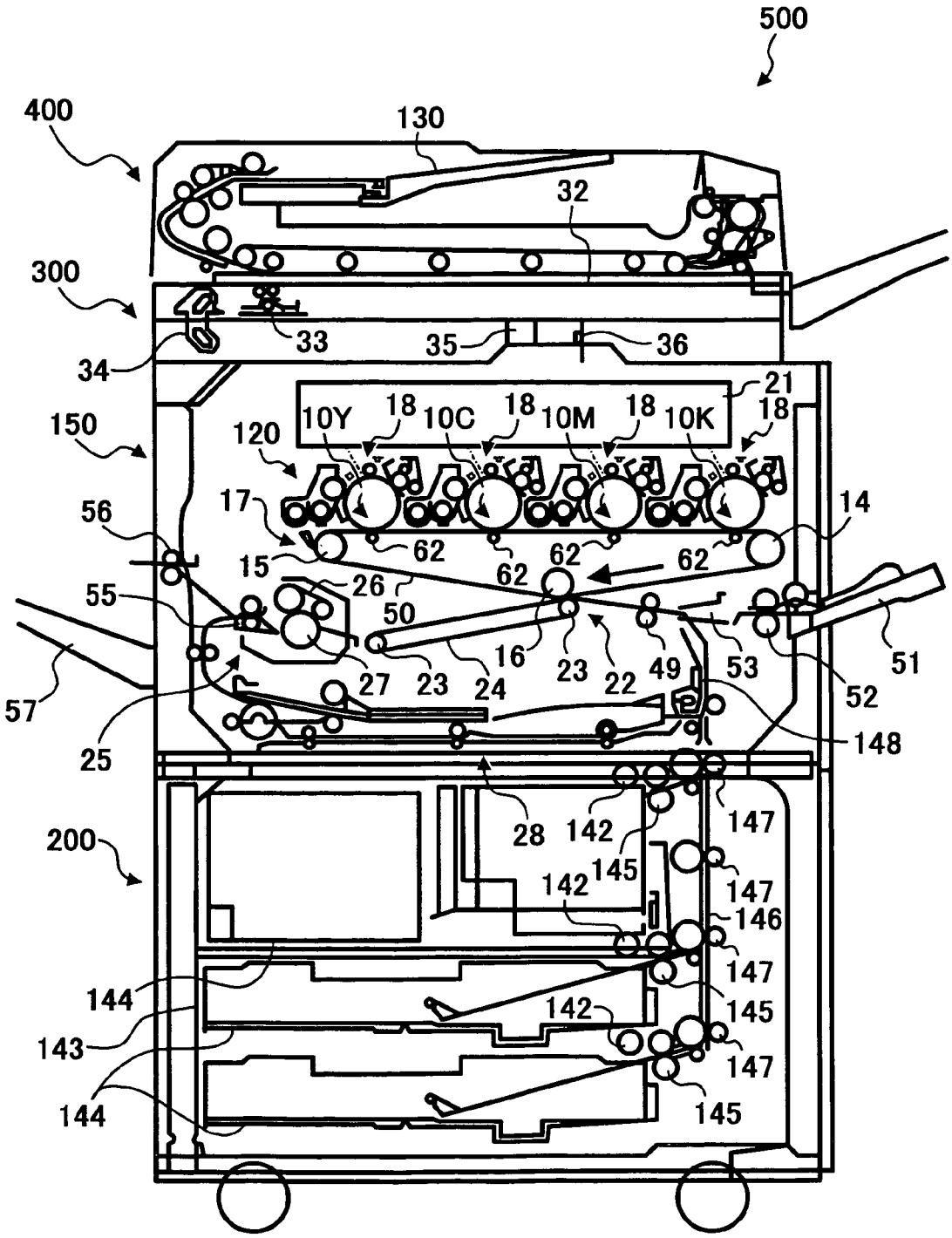
FIG. 3 is a schematic view illustrating another image forming apparatus for use in the image forming method of the present invention.

FIG. 3 is the overview of another image forming apparatus for use in the image forming method of the present invention, which is a tandem-type color image forming apparatus.

In FIG. 3, a tandem-type color image forming apparatus 500 includes an image forming section 150, a paper feeding section 200, a scanner 300 and an automatic document feeder 400.

The image forming section 150 includes an endless intermediate transfer medium 50 which is provided in the center of the image forming section 150. The intermediate transfer medium 50 is rotated in the clockwise direction by rollers 14, 15 and 16 while tightly stretched by the rollers. A cleaner 17 is provided near the roller 25 to remove particles of the toner remaining on the surface of the intermediate transfer medium.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 120 denotes a tandem type developing device. The developing device 120 includes four developing devices arranged in the respective four image forming units 18. A light irradiator 21 is arranged at a location over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27 which presses the fixing belt 26.

In addition, a sheet reversing device 28 configured to reverse the receiving material is provided at a position near the fixing device 25, to produce double-sided copies.

Then the full color image forming operation of the tandem-type color image forming apparatus 500 will be explained.

An original to be copied is set on an original table 130 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C. The toner image forming operation is the same as that mentioned in the image forming apparatus illustrated in FIG. 2.

Then the process cartridge of the present invention will be explained.

The process cartridge of the present invention includes at least a developing device configured to develop an electrostatic latent image formed on an image bearing member with a developer including the toner of the present invention, and optionally includes one or more devices such as photoreceptors, chargers and cleaners.

Figure 4:
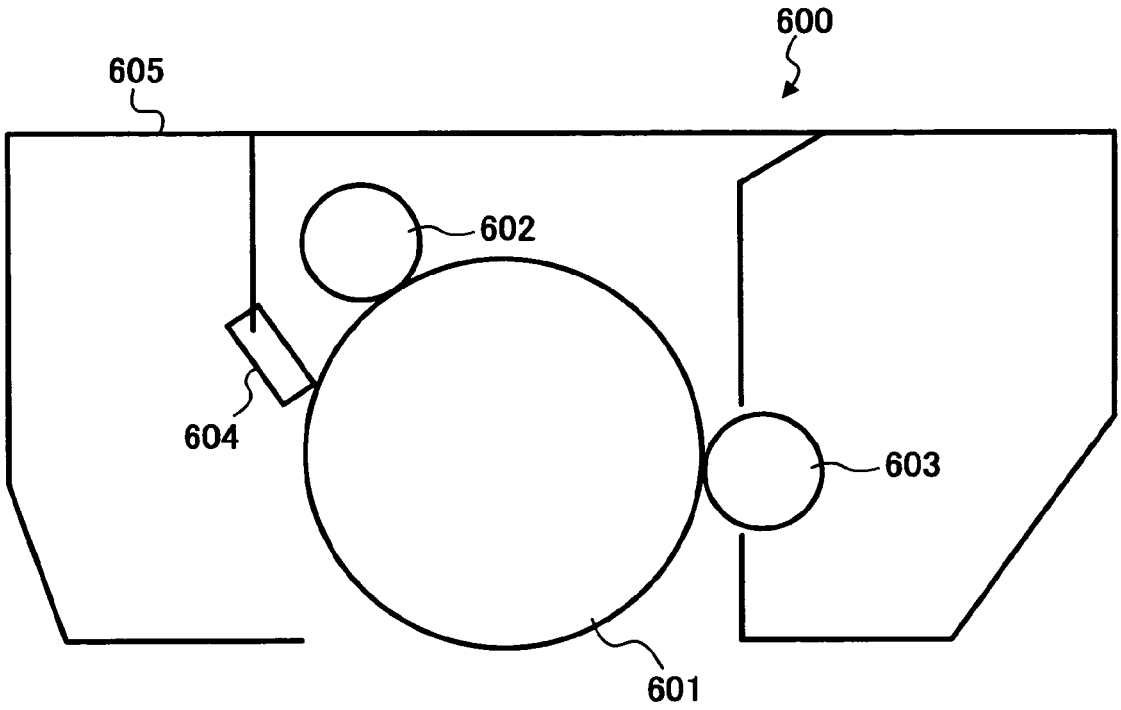
FIG. 4 is a schematic view illustrating an embodiment of the process cartridge of the present invention.

FIG. 4 is a schematic view illustrating an embodiment of the process cartridge of the present invention.

Numeral 600 denotes the process cartridge. The process cartridge 600 includes a photoreceptor 601, a charger 602, a developing device 603, a cleaner 604 and a housing 605.

The toner of the present invention is used for the process cartridge 600.

The process cartridge 600 can be detachably set in an image forming apparatus such as copiers and printers.

The image forming apparatus including such a process cartridge can perform image forming operations similar to those mentioned above (i.e., charging, irradiating, developing, transferring, fixing, cleaning, etc.).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example 1

The following components were mixed with a HENSCHEL MIXER.

| | |
|---|---|
| Crystalline polyester resin (A1) | 15 parts |
| Noncrystalline polyester resin (B1) | 85 parts |
| Carnauba wax subjected to free-fatty-acid removing treatment (glass transition temperature: 83° C.) | 5 parts |
| Carbon black (#44 from Mitsubishi Chemical Corp.) | 10 parts |

The formulae of the resins (A1) and (B1) are described in Table 1 below.

The mixture was kneaded with a two-axis extruder and then cooled. In this regard, the temperature of the two-axis extruder was set to the minimum of the temperature range in which the mixture is melted. As a result, the temperature of the kneaded mixture was 120° C. at the exit of the extruder. Then the kneaded mixture was pulverized and classified. Thus, black toner particles having a weight average particle diameter of about 6.5 μm was prepared. The toner included toner particles having a particle diameter not greater than 5 μm in an amount of 80% by quantity (i.e., by number).

The thus prepared toner particles were mixed with 0.5 parts by weight of a hydrophobic silica and 0.3 parts by weight of a titanium oxide to prepare a toner No. 1.

Toner Preparation Example 2-1

The procedure for preparation of the toner in Toner Preparation Example 1 was repeated except that the weight average particle diameter was changed to 2.7 μm and the content of toner particles having a particle diameter not greater than 5 μm was changed to 93%. Thus, a toner No. 2-1 was prepared.

Toner Preparation Example 2-2

The procedure for preparation of the toner in Toner Preparation Example 1 was repeated except that the weight average particle diameter was changed to 9.5 μm and the content of toner particles having a particle diameter not greater than 5 μm was changed to 55%. Thus, a toner No. 2-2 was prepared.

Toner Preparation Example 3

The procedure for preparation of the toner in Toner Preparation Example 1 was repeated except that the crystalline polyester resin (A1) was replaced with a crystalline polyester (A2), details of which are described in Tables 1 and 2. Thus, a toner No. 3 was prepared.

Toner Preparation Example 4

The procedure for preparation of the toner in Toner Preparation Example 1 was repeated except that the crystalline polyester resin (A1) was replaced with a crystalline polyester (A3), details of which are described in Tables 1 and 2. Thus, a toner No. 4 was prepared.

Toner Preparation Example 5

The procedure for preparation of the toner in Toner Preparation Example 1 was repeated except that the crystalline polyester resin (A1) was replaced with a crystalline polyester (A4), details of which are described in Tables 1 and 2. Thus, a toner No. 5 was prepared.

Toner Preparation Example 6

The procedure for preparation of the toner in Toner Preparation Example 1 was repeated except that the formula of the toner was changed to the following.

| | |
|---|---|
| Crystalline polyester resin (A1) | 60 parts |
| Noncrystalline polyester resin (B1) | 40 parts |
| Carnauba wax subjected to free-fatty-acid removing treatment (glass transition temperature: 83° C.) | 5 parts |
| Carbon black (#44 from Mitsubishi Chemical Corp.) | 10 parts |

Thus, a toner No. 6 was prepared.

Toner Preparation Example 7

The procedure for preparation of the toner in Toner Preparation Example 1 was repeated except that the formula of the toner was changed to the following.

| | |
|---|---|
| Crystalline polyester resin (A1) | 0.5 parts |
| Noncrystalline polyester resin (B1) | 90.5 parts |
| Carnauba wax subjected to free-fatty-acid removing treatment (glass transition temperature: 83° C.) | 5 parts |
| Carbon black (#44 from Mitsubishi Chemical Corp.) | 10 parts |

Thus, a toner No. 7 was prepared.

Toner Preparation Example 8

The procedure for preparation of the toner in Toner Preparation Example 1 was repeated except that the noncrystalline polyester resin (B1) was replaced with a noncrystalline polyester (B2), details of which are described in Tables 3 and 4. Thus, a toner No. 8 was prepared.

Toner Preparation Example 9

The procedure for preparation of the toner in Toner Preparation Example 1 was repeated except that the noncrystalline polyester resin (B1) was replaced with a noncrystalline polyester (B3), details of which are described in Tables 3 and 4. Thus, a toner No. 9 was prepared.

Toner Preparation Example 10

The procedure for preparation of the toner in Toner Preparation Example 1 was repeated except that the carnauba wax was replaced with a polyethylene wax having a glass transition temperature of 110° C. Thus, a toner No. 10 was prepared.

Toner Preparation Example 11

The procedure for preparation of the toner in Toner Preparation Example 1 was repeated except that the carnauba wax was replaced with a polyethylene wax having a glass transition temperature of 58° C. Thus, a toner No. 11 was prepared.

The crystalline polyester resins A1 to A4 were prepared by reacting the components described in Table 1.

TABLE 1

| Polyester resin | Acid component (molar ratio) | Alcohol component (molar ratio) |
|---|---|---|
| Polyester resin A1 | Fumaric acid: 88.6<br>Succininc acid: 4.9<br>Trimellitic anhydride: 6.5 | 1,4-butanediol: 100 |
| Polyester resin A2 | Terephthalic acid: 11.5<br>Trimellitic anhydride: 18.4 | BPA/PO: 36.8<br>BPA/EO: 33.3 |
| Polyester resin A3 | Fumaric acid: 93.5<br>Trimellitic anhydride: 6.5 | 1,4-butanediol: 100 |
| Polyester resin A4 | Fumaric acid: 100 | 1,6-hexanediol: 100 |

Note 1):
BPO/PO means a propyleneoxide (2.2 mole) adduct of bisphenol A
BPO/EO means an ethyleneoxide (2.2 mole) adduct of bisphenol A
Note 2):
the numbers of the acid component and alcohol component in polyester resin A2 represent weight ratios.

Each of polyester resins A1-A4 was prepared by the following method.

At first, 4000 g of the components described in Table 1 and 4 g of hydroquinone were contained in a 5-liter four neck flask equipped with a thermometer, a stirrer, a condenser and a nitrogen gas feed pipe. Then the flask was set on a mantle heater. After nitrogen gas was fed into the flask so that the inside of the flask is in an inert gas environment, the components were heated. The components were heated at 160° C. for 5 hours, followed by heating at 200° C. for 1 hour. Further, the components were reacted at 200° C. for 1 hour under a pressure of 8.3 kPa. Thus, a crystalline polyester resin was prepared.

The properties of the thus prepared polyester resins A1 to A4 are described in Table 2.

TABLE 2

| Polyester | Crystal-Linity* | Ester Bond (1)** | T (F½) (° C.) | Tg (° C.) | Mn | Mw |
|---|---|---|---|---|---|---|
| A1 | Yes | Yes | 116 | 118 | 1530 | 6400 |
| A2 | No | No | 128 | 60 | 2200 | 6900 |
| A3 | Yes | Yes | 137 | 136 | 1910 | 9820 |
| A4 | Yes | Yes | 69 | 70 | 1130 | 2260 |

Crystallinity*: "Yes" means that the resin has a peak in each of the Bragg (2) angle range of from 19 to 20°, 21 to 22°, 23 to 25° and 29 to 31° when the resin is subjected to the X-ray diffraction analysis.
Ester bond (1)**: "Yes" means that the resin has the ester bond represented by the formula (1), —OOC—R—COO—$(CH_2)$n—.

Ester bond (1)**: "Yes" means that the resin has the ester bond represented by formula (1), —OOC—R—COO—$(CH_2)_n$—.

The noncrystalline polyester resins B1 to B3 were prepared by reacting the components described in Table 3.

TABLE 1

| Polyester resin | Acid component (molar ratio) | Alcohol component (molar ratio) |
|---|---|---|
| Polyester resin B1 | Fumaric acid: 18.4<br>Trimellitic anhydride: 10.5 | BPA/PO: 36.8<br>BPA/EO: 34.2 |
| Polyester resin B2 | Trimellitic anhydride: 9<br>Terephthalic | BPA/PO: 47.1<br>BPA/EO: 18.8 |

TABLE 1-continued

| Polyester resin | Acid component (molar ratio) | Alcohol component (molar ratio) |
|---|---|---|
| Polyester resin B3 | acid: 14.1<br>Dodecenyl succinic anhydride: 11.8<br>Terephthalic acid: 9.2<br>Fumaric acid: 13.8<br>Trimellitic anhydride: 12.6 | BPA/PO: 46<br>BPA/EO: 19.3 |

Note 1):
BPO/PO means a propyleneoxide (2.2 mole) adduct of bisphenol A
BPO/EO means an ethyleneoxide (2.2 mole) adduct of bisphenol A Each of polyester resins B1-B3 was prepared by the following method.

At first, 4000 g of the components described in Table 3 were contained in a 5-liter four neck flask equipped with a thermometer, a stirrer, and a condenser. Then the flask was set on a mantle heater. After 4 g of dibutyltin oxide was added to the flask, the components were heated. The components were heated at 220° C. for 8 hours. Further, the components were reacted at 220° C. for 1 hour under a pressure of 8.3 kPa to prepare a noncrystalline polyester resin having the target softening point. Thus, a noncrystalline polyester resin was prepared.

The properties of the thus prepared polyester resins B1 to B3 are shown in Table 4.

TABLE 4

| Polyester | T(F½) (° C.) | Tg (° C.) | Mn | Mw |
|---|---|---|---|---|
| B1 | 148 | 60 | 2053 | 77730 |
| B2 | 169 | 68 | 3648 | 55260 |
| B3 | 119 | 39 | 2460 | 5953 |

Carrier Preparation Example

The following components were mixed using a stirrer to prepare a coating liquid.

| | |
|---|---|
| Toluene | 450 parts |
| Silicone resin<br>(SR2400 from Dow Corning Toray Silicone, solid content of 50%) | 450 parts |
| Aminosilane<br>(SH6020 from Dow Corning Toray Silicone Co., Ltd.) | 10 parts |
| Carbon black | 10 parts |

Then the coating liquid and a particulate Cu—Zn ferrite which serves as a core material and which has a volume average particle diameter of 45 μm were mixed in a coating apparatus having a vessel in which a bottom plate and an agitating blade are rotated to form swirling air flow. Thus, the surface of the core material was coated with the coating liquid.

The coated core material was then heated at 250° C. for 2 hours in an electric furnace. As a result of analysis of the carrier, it was found that the thus prepared carrier have a saturation magnetization of 0.065 A·m/g (65 emu/g) at 3 kOe, a residual magnetization of 0 A·m/g (0 emu/g) at 3 kOe, a resistivity of $3.2\times10^8$ Ω·cm and a volume average particle diameter of 45 μm.

Developer Preparation Examples 1 to 11

The following components were mixed using a TURBULA mixer to prepare developers 1-11.

| | |
|---|---|
| Each of toners Nos. 1-11 | 2.5 parts |
| Carrier prepared above | 97.5 parts |

Examples 1-10 and Comparative Examples 1-1, 1-2, 2, 3-1, 3-2 and 4

The toners Nos. 1-11 and the toners (developers) Nos. 1-11 were evaluated using fixing devices Nos. 1 and 2.

| Example | Toner | Fixing device | Comparative Example | Developer | Fixing device |
|---|---|---|---|---|---|
| 1 | No. 1 | No. 1 | 1-1 | No. 2-1 | No. 1 |
| 2 | No. 4 | No. 1 | 1-2 | No. 2-2 | No. 1 |
| 3 | No. 5 | No. 1 | 2 | No. 3 | No. 1 |
| 4 | No. 6 | No. 1 | 3-1 | No. 2-1 | No. 2 |
| 5 | No. 7 | No. 1 | 3-2 | No. 2-2 | No. 2 |
| 6 | No. 8 | No. 1 | 4 | No. 3 | No. 2 |
| 7 | No. 9 | No. 1 | — | — | — |
| 8 | No. 10 | No. 1 | — | — | — |
| 9 | No. 11 | No. 1 | — | — | — |
| 10 | No. 1 | No. 2 | — | — | — |

The evaluation methods are as follows.

1. Fixing properties (low temperature fixability and hot offset resistance)

Each of the developers Nos. 1-11 was set in a copier, which is IMAGIO NEO 350 manufactured by Ricoh Co., Ltd. and which had been modified such that the fixing device can be replaced with another fixing device and the temperature of the fixing device can be changed.

A copying test was performed under the following conditions.

(1) Receiving material

TYPE 6200 from Ricoh Co., Ltd.

(2) Fixing device

1) Fixing device No. 1

The fixing device No. 1 has a configuration illustrated in FIG. 1, and includes the following members.

(A) Fixing roller

A roller in which an offset preventing layer of PTFE having a thickness of 16 μm is formed on a peripheral surface of an aluminum cylinder having a thickness of 0.5 mm.

(B) Pressure roller

A roller in which an offset preventing layer having a silicone rubber layer with a thickness of 3 μm and a PFA layer with a thickness of 30 μm located thereon is formed on a aluminum cylinder having a thickness of 1 mm.

(C) Pressure: $9\times10^4$ Pa (D) Fixing speed: 180 mm/s

2) Fixing device No. 2

The fixing device No. 2 also has a configuration illustrated in FIG. 1, and includes the following members.

(A) Fixing roller

A roller in which an offset preventing layer of PTFE having a thickness of 20 μm is formed on a peripheral surface of a stainless steel (SUS) cylinder having a thickness of 3.0 mm.

(B) Pressure roller

A roller in which an offset preventing layer having a silicone rubber layer with a thickness of 4 μm and a PFA layer with a thickness of 50 μm located thereon is formed on a aluminum cylinder having a thickness of 2 mm.

(C) Pressure: $2.5\times10^5$ Pa (D) Fixing speed: 180 mm/s

The copying test was performed while the fixing temperature was changed to determine the maximum cold offset temperature at or below which a cold offset phenomenon occurs and the minimum hot offset temperature at or above which a hot offset phenomenon occurs. In this test, the fixing speed was set to be 50 mm/sec because this condition is severer with cold and hot offset phenomena.

Evaluation of Low Temperature Fixability

The low temperature fixability of each of the developers 1-11 is graded into the following 5 ranks.

◎: The maximum cold offset temperature is lower than 130° C.

○: The maximum cold offset temperature is not lower than 130° C. and lower than 140° C.

□: The maximum cold offset temperature is not lower than 140° C. and lower than 150° C.

Δ: The maximum cold offset temperature is not lower than 150° C. and lower than 160° C.

X: The maximum cold offset temperature is not lower than 160° C.

Evaluation of Hot Offset Resistance

The hot offset resistance of each of the developers 1-11 is graded into the following 5 ranks.

◎: The minimum hot offset temperature is not lower than 201° C.

○: The minimum hot offset temperature is not lower than 191° C. and not higher than 200° C.

□: The minimum hot offset temperature is not lower than 181° C. and not higher than 190° C.

Δ: The minimum hot offset temperature is not lower than 171° C. and not higher than 180° C.

X: The minimum hot offset temperature is not higher than 170° C.

2. Image qualities (Background development and fine line reproducibility)

Background Development

Each of the developers was set in a copier MF-2200 manufactured by Ricoh Co., Ltd. to perform a running test in which 100,000 copies are continuously produced under a normal temperature/normal humidity condition. The copied images were visually observed to determine whether the images have background fouling. The quality of background of images was graded into the following five ranks.

◎: Excellent

○: Good

□: Fair

Δ: Acceptable (the background of the image is on a level so as to be able to be used practically)

X: Not acceptable (the background of the image is on a level so as not to be able to be used practically)

Fine Line Reproducibility

A lattice image constituted of one-dot images having dot densities of 600 dot/25.4 mm in the main scanning direction and 150 line/25.4 mm in the sub-scanning direction was formed. The lattice image was evaluated to determine whether there are omissions or low density portions in the lattice image. The quality of fine line reproducibility was graded into the following five ranks.

◎: Excellent

○: Good

□: Fair

Δ: Bad

X: Seriously bad

3. Preservability

Each toner was contained in a glass container, and the toner was allowed to settle for 24 hours in a chamber heated to 50° C. After being cooled to 24° C., the toner was subjected to a penetration test using a method based on JIS K2235-1991 to determine the penetration of the toner in the glass container. In this regard, the more penetration value a toner has, the better preservability the toner has. The preservability of toners is graded into the following five ranks:

◎: Penetration is not less than 25 mm.

○: Penetration is not less than 20 mm and less than 25 mm.

Δ: Penetration is not less than 15 mm and less than 20 mm.

X: Penetration is less than 15 mm. (worst)

4. Confirmation of Phase Separation Structure

A toner particle was cut to prepare an ultra thin section having a thickness of about 100 μm and the ultra thin section was dyed with $RuO_4$. The dyed ultra thin section was observed with a transmission electron microscope (TEM) of 10,000 power magnification to determine whether the toner has a phase separation structure (i.e., whether the binder resins achieve a phase separation state).

5. Confirmation of Whether Toner has Crystallinity (1) X-ray Diffraction Analysis In order to determine whether a toner has crystallinity, the toner was subjected to an X-ray diffraction analysis under the following measuring conditions.

Measurement instrument used: RINT1100 from Rigaku Corp.

Target: Cu

Voltage: 50 kV

Current: 30 mA

Goniometer: wide angle goniometer

The X-ray diffraction spectrum was observed to determine whether the toner has crystallinity (i.e., whether there is a peak in each of Bragg (2θ) angle ranges of from 19 to 20°, 21 to 22°, 23 to 25°, and 29 to 31°).

(2) DSC

The toner was subjected to differential scanning calorimetry under the following conditions.

Measuring instrument: THERMOFLEX TG8110 from Rigaku Corp.

Temperature rising speed: 10° C./min

In Table 5, "yes" means that endothermic peaks (A), (B) and (C) having respective peak tops in temperature ranges of from 40 to 70° C., from 70 to 90° C., and from 80 to 130° C. were observed.

6. Molecular weight of binder resins (1) Polyester resins B1-B3 and A2

The molecular weight distribution of each of the resins was determined by gel permeation chromatography (GPC). The method is as follows.

1) the column is allowed to settle in a chamber heated to 40° C. so as to be stabilized;

2) tetrahydrofuran (THF) is passed through the column heated to 40° C. at a flow rate of 1 ml/min;

3) 50 to 200 μl of a 0.5% by weight tetrahydrofuran (THF) solution of a sample is injected to the column to obtain a molecular distribution curve.

The THF resin solution of the resin was prepared by the following method:

i) the resin is dissolved in tetrahydrofuran to prepare a 0.5% by weight THF solution of the resin;

ii) the resin solution is subjected to ball milling for 24 hours; and iii) the resin solution is subjected to filtering using a Membrane filter having holes with a diameter of 0.2 μm.

The molecular weight distribution of the sample is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes are available from Pressure Chemical Co., or Tosoh Corp. It is preferable to prepare a working curve using ten or more kinds of monodisperse polystyrenes. In measurements, it is preferable to use a RI (refractive index) detector as the detector.

(2) Polyester resins A1, A3 and A4

The molecular weight distribution of these resins was determined by gel permeation chromatography (GPC). The method is as follows.

1) the column is allowed to settle in a chamber heated to 145° C. so as to be stabilized;

2) o-dichlorobenzene including BHT in an amount of 0.3% is passed through the column at a flow rate of 1 ml/min;

3) 50 to 200 μl of a 0.3% by weight o-dichlorobenzene solution of a sample which had been heated to 140° C. is injected to the column to obtain a molecular distribution curve. The measuring conditions are as follows.

Instrument used: 150CV from Waters

Column used: SHODEX AT-G+AT-806MS (2 pieces)

7. Determination of whether toner include group having formula (1)

Whether the toner includes a group having formula (1) is determined by subjecting the toner to a solid $^{13}$C-NMR analysis under the following conditions.

Instrument used: FT-NMR SYSTEM JNM-α400 from JEOL Ltd.)

Measurement nucleus: $^{13}$C

Reference material: adamantane

Number of accumulation: 8192 times

Pulse sequence: CPMAS

IRMOD: IRLEV

Measurement frequency: 100.4 MHz

OBSET: 134500 Hz

POINT: 4096

PD: 7.0 sec

SPIN: 6088 Hz

Software used for analysis: CHEM DRAW PRO Ver. 4.5

In addition to the solid $^{13}$C-NMR analysis, the toner is also subjected to a FT-IR analysis and a pyrolysis gas chromatographic analysis to support the results of the NMR analysis. The details of the analyses are as follows.

1) FT-IR (Fourier transform infrared spectrophotometry)

The toner was subjected to transmission FT-IR, and the spectrum is compared with the standard spectrum. The measuring conditions are as follows.

Instrument used: NICOLET MAGNA 850

Measurement range: 4000 to 400 $cm^{-1}$

Reference material: KBr

2) Pyrolysis Gas Chromatographic Analysis

Thee heat decomposition materials of the toner were analyzed using a pyrolysis gas chromatographic analyzer. The measurement conditions are as follows.

Instrument used: GC-17 and CR-4A from Shimadzu Corp.

Heating chamber: JHB-3S from Japan Analytical Industry Co., Ltd.

Pyrolysis condition: 590° C. (temperature)×4 sec (time)

Column: DB-5 (J and W Co.)

Length: 30 m

Inside diameter: 0.25 mm

Film: 0.25 mm

Column temperature: The temperature was raised from 50° C. (retained at the temperature for 1 min) to 300° C. at a speed of 10° C./min.

Injection temperature: 320° C.

Carrier gas pressure: The pressure was raised from 90 kPa (retained at the pressure for 2 min) to 150 kPa at a speed of 2 kPa/min.

Detector: FID

The evaluation results are shown in Tables 5 and 6.

TABLE 5

| | Developer No. | Phase separation structure | Endothermic peaks | Crystallinity |
|---|---|---|---|---|
| Ex. 1 | No. 1 | Yes | Yes | Yes |
| Comp. Ex. 1-1 | No. 2-1 | Yes | Yes | Yes |
| Comp. Ex. 1-2 | No. 2-2 | Yes | Yes | Yes |
| Comp. Ex. 2 | No. 3 | No | No | No |
| Ex. 2 | No. 4 | Yes | No | Yes |
| Ex. 3 | No. 5 | Yes | No | Yes |
| Ex. 4 | No. 6 | Yes | Yes | Yes |
| Ex. 5 | No. 7 | Yes | Yes | Yes |
| Ex. 6 | No. 8 | Yes | Yes | Yes |
| Ex. 7 | No. 9 | Yes | Yes | Yes |
| Ex. 8 | No. 10 | Yes | Yes* | Yes |
| Ex. 9 | No. 11 | Yes | Yes** | Yes |
| Ex. 10 | No. 1 | Yes | Yes | Yes |

Yes*: The endothermic peak (B) specific to the release agent is present at 108° C. although the peak (B) is preferably present in a range of from 70 to 90° C.

Yes**: The endothermic peak (B) specific to the release agent is present at 57° C. although the peak (B) is preferably present in a range of from 70 to 90° C.

TABLE 6

| | Fixing device No. | Low temp. fixability | Hot offset resistance | High temp. Preservability | Background fouling | Fine line reproducibility |
|---|---|---|---|---|---|---|
| Ex. 1 | No. 1 | ◎ | ◎ | ○ | ◎ | ◎ |
| Comp. Ex. 1-1 | No. 1 | ◎ | ◎ | ○ | X | ○ |
| Comp. Ex. 1-2 | No. 1 | ○ | ◎ | ○ | ◎ | X |
| Comp. Ex. 2 | No. 1 | X | □ | ○ | ○ | ○ |
| Ex. 2 | No. 1 | ○ | ◎ | ○ | ◎ | ◎ |
| Ex. 3 | No. 1 | ◎ | ○ | ○ | ◎ | ◎ |

TABLE 6-continued

| | Fixing device No. | Low temp. fixability | Hot offset resistance | High temp. Preservability | Background fouling | Fine line reproducibility |
|---|---|---|---|---|---|---|
| Ex. 4 | No. 1 | ◎ | □ | ○ | ○ | ○ |
| Ex. 5 | No. 1 | Δ | ◎ | ○ | ◎ | ◎ |
| Ex. 6 | No. 1 | ◎ | ◎ | ○ | ◎ | ◎ |
| Ex. 7 | No. 1 | ◎ | Δ | □ | ◎ | ◎ |
| Ex. 8 | No. 1 | ◎ | Δ | ○ | ◎ | ◎ |
| Ex. 9 | No. 1 | ◎ | ○ | X | ◎ | ◎ |
| Ex. 10 | No. 2 | ○* | ○* | ○ | ◎ | ◎ |
| Comp. Ex. 3-1 | No. 2 | ○* | Δ* | ○ | X | ○ |
| Comp. Ex. 3-2 | No. 2 | X* | □* | ○ | ◎ | X |
| Comp. Ex. 4 | No. 2 | X* | □* | ○ | ○ | ○ |

○*, □*, Δ*, X*: It takes a long time until the temperature of the fixing device reaches the predetermined fixing temperature.

Effects of the Present Invention

The toner of the present invention has a good combination of high temperature preservability and low temperature fixability because of including a crystalline polyester resin with a specific structure and having a specific particle diameter and a specific particle diameter distribution.

When the toner of the present invention is used for fixing devices in which one or more thin cylindrical rollers are contacted at a low pressure, the resultant toner images have good fixability.

The electrophotographic image forming method and process cartridge of the present invention can produce high quality and high definition images having good low temperature fixability and good durability without causing a background fouling problem.

This document claims priority and contains subject matter related to Japanese Patent Application No. 2004-136070, filed on Apr. 30, 2004, incorporated herein by reference.

Having now fully described the invention, it will be apparent to one of ordinary skill in the art that many changes and modifications can be made thereto without departing from the spirit and scope of the invention as set forth therein.

What is claimed is:

1. An image forming apparatus for fixing a toner image, comprising:

a first roller having a heater therein, a second roller, wherein the first roller is a cylinder having a thickness not greater than 1.0 mm and the first and second rollers are rotated while contacted with each other at a pressure not greater than $1.5\times10^5$ Pa, and a nip between the first and second rollers passing through a support bearing the toner image so that the toner image contacts the first roller, wherein the toner image is formed of a toner comprising:

a colorant;

a binder resin comprising:

a polyester resin (A) having a crystallinity and the represented by the formula (1):

$$—OOC—R—COO—(CH_2)_n— \quad (1)$$

wherein R represents an unsaturated linear aliphatic group having from 2 to 20 carbon atoms, and n is an integer of from 2 to 20; and a release agent, wherein a molar ratio of the ester bond of the crystalline polyester resin to total ester bonds included in the binder resin is not less than 0.60, and wherein the toner has a weight average particle diameter of from 3.0 to 9.0 μm, and includes toner particles having a particle diameter not greater than 5 μm in an amount of from 60 to 90% by quantity when the weight average particle diameter and particle diameter are measured using a MULTISIZER manufactured by Beckmann Coulter, Inc.

2. The image forming apparatus according to claim 1, wherein the toner has a thermal property such that when the toner is subjected to differential scanning calorimetry, the toner has at least three endothermic peaks, wherein peak tops of the first, second and third peaks are present in temperature ranges of from 40 to 70° C., from 70 to 90° C. and from 80 to 130° C., respectively.

3. The image forming apparatus according to claim 1, wherein the toner has an X-ray diffraction spectrum such that a diffraction peak is observed at a Bragg (2θ) angle of from 20° to 25°.

4. The image forming apparatus according to claim 1, wherein the crystalline polyester resin has a softening point of from 80 to 130° C. and a glass transition temperature of from 80 to 130° C.

5. The image forming apparatus according to claim 1, wherein the crystalline polyester resin is included in the toner in an amount of from 1 to 50% by weight based on a total weight of the toner.

6. The image forming apparatus according to claim 1, wherein the crystalline polyester resin comprises an alcohol unit obtained from 1,4-butanediol or 1,6-hexanediol and an acid unit obtained from maleic acid or fumaric acid.

7. The image forming apparatus according to claim 1, wherein the binder resin further comprises a noncrystalline polyester resin having a glass transition temperature of from 40 to 70° C. and a softening point of from 120 to 160° C.

8. The image forming apparatus according to claim 1, wherein the release agent has a glass transition temperature of from 70 to 90° C.

9. The image forming apparatus according to claim 1, wherein the crystalline polyester resin has an X-ray diffraction spectrum such that a diffraction peak is observed in each of Bragg (2θ) angle ranges of from 19° to 20°, 21° to 22°, 23° to 25° and 29° to 31°.

* * * * *